US005605112A

United States Patent [19]

Schuman

[11] Patent Number: 5,605,112

[45] Date of Patent: Feb. 25, 1997

[54] STORAGE BAG HAVING TIE-DOWN STRAPS FOR BOATS AND METHOD OF USE THEREOF

[76] Inventor: Michelle Schuman, P.O. Box 242, Sutton, Ak. 99674

[21] Appl. No.: 520,892

[22] Filed: Aug. 31, 1995

[51] Int. Cl.[6] ..... B63B 17/00

[52] U.S. Cl. ..... 114/343; 114/364; 224/406; 224/572; 383/16; 383/18; 383/42

[58] Field of Search ..... 114/343, 347, 114/364; 383/16, 18, 42, 78, 84; 224/406, 572

[56] References Cited

U.S. PATENT DOCUMENTS 3,674,073 7/1972 Hendon ..... 383/18

4,569,301 2/1986 Pyburn ..... 114/364

4,739,720 4/1988 Jarschke ..... 114/347

*Primary Examiner*—Sherman Basinger

*Attorney, Agent, or Firm*—Michael J. Tavella

[57] ABSTRACT

A durable gear bag designed for use in white water rafts and other small water craft. Heavy weight polypropylene webbing is sewn along the bottom of the bag. D-rings are attached to extensions of the webbing. The bag is then attached to the D-rings of a raft using common boat straps. The bag/strap configuration permits many different strapping arrangements for use in a variety of water craft. The top of the bag is fitted with strips of common hook and loop fasteners (such as VELCRO). These strips are sealed and rolled down snugly. Three snap release connectors are then used to secure the top of the bag. When not in use, the bag can be folded or stuffed for easy packing.

11 Claims, 5 Drawing Sheets

STORAGE BAG HAVING TIE-DOWN STRAPS FOR BOATS AND METHOD OF USE THEREOF

This invention relates to gear storage bags for use in boating and particularly to gear storage bags utilizing D-ring strapping mechanisms for securing the bag to a raft or boat.

BACKGROUND OF THE INVENTION

There is a growing interest in water sports of all types. White water rafting is one such sport that is attracting outdoor adventurers not only in the United States but internationally as well. Growth in rafting has reached the point where permits are required to run rafts on many rivers in the United States. Other water activities are also growing. Canoes, riverboats and small ocean vessels have increasing popularity.

As the use of small water craft grows, so does the need for safe and efficient boating equipment. One piece of equipment used in rafting is the gear bag. Large rafting trips often use two or three baggage boats to carry camping gear, food and other supplies in these gear bags. Many types of bags are now available to carry this equipment. The trouble is securing these bags to the raft or boat so that they are not lost in rough water or accidentally knocked overboard. A common method for securing the bags to a raft is to run "boat straps" through the straps on the gear bags. This process is time consuming and must be done at every camp site.

Another method uses a frame platform secured to raft with D-rings and boat straps. The gear is placed on the platform and covered by netting. A boat strap is then woven throughout the netting and secured to the raft. Although this method may be more efficient, it is also dangerous. Depending on the size of the gaps in the netting, it is sometimes possible to get a hand, watch or other object caught in the net. If the raft should capsize, the rider is stuck and could drown.

Many types of waterproof and other types of bags have been developed over time. Some of these bags have mechanisms that can be used to tie the bag to a boat. One example of such a bag is found in U.S. Pat. No. 4,099,656 to Neumann et al. The Neumann et al. patent teaches a bag that can be used as a storage bag or water carrier. The bag has six rings sewn to the bottom of the bag. Four of the rings are arranged in a rectangle. The remaining two rings are attached near the long ends of the bag, along the center axis. A strap is provided that be used carry the bag. The patent also mentions that the rings can be used to lash the bag to a canoe or other vehicles. Although the Neumann bag is very useful, it is limited in its application for carrying supplies for river rafting. It is primarily designed for backpacking, which keeps it small. Moreover, while the placement of the rings on the Neumann patent, within the perimeter of the bottom of the bag, is essential for Neuman's bag to be used as a backpack, it is far from ideal for lashing the bag to a raft or canoe. The rings as placed in the Neumann bag make the bag top heavy. Tied down in this way, the bag has a tendency to roll excessively. Moreover, tying the bag in place requires running the lines under the bag, which can be difficult if the bag is heavy. Finally, inverting the bag to overcome the balance problem causes problems because the access zipper is then at the bottom of the bag, making access to the contents during the trip impossible.

SUMMARY OF THE INVENTION

The present invention overcomes these problems. The instant invention is a durable gear bag specifically designed to stow gear easily and quickly for white water rafting or for other small craft use. The invention is a bag that has front and back panels. A bottom panel, that has extension panels, is attached to the front and back panels to form the bottom and sides of the bag. This construction forms a bag with an open interior compartment to store supplies. The bottom of the bag is reinforced by stitching two inch polypropylene webbing along the front and back seams. This webbing is extended out from the bag by four inches. One D-ring is Page 2 attached to each piece of webbing. A third length of webbing is attached to the center of the bottom. Again four inch lengths of the webbing extend past the end of the bag to which D-rings are attached. This arrangement eliminates the problems of the Neumann bag. First, the straps reinforce the bottom of the bag. Second, because they extend outward from the bag, boat straps can be easily passed through the rings. Finally, by extending the rings out from the bottom of the bag, better balance can be achieved with the bag tied in place than if the boat straps were secured under the bag.

The number of D-rings and webbing supports depends on the size of the raft. Rafts or boats shorter than eleven feet six inches long have five D-rings. Rafts and boats 11'6" to 13'6" in length may have up to eight D-rings. Boats longer than 13'6" may have up to ten D-rings. All of the D-rings on the bag are secured to the D-rings on the raft using common boat straps.

To close and secure the bag, a number of snap release type connector buckles are attached to the outside of the bag. In addition to the buckles, two- two inch wide hook and loop type fastener (i.e., VELCRO) strips are stitched on the inside top of the bag. To close the bag, the hook and loop strips are secured. The top of the bag is then rolled down tightly to the level of capacity, and the buckles are secured and cinched.

It is an object of this invention to produce a storage bag for use in rafts or boats that can be secured to the raft in a safe and efficient manner.

It is another object of this invention to produce a storage bag for use in rafts and boats that can be secured to the raft or boat using ordinary boat straps.

It is yet another object of this invention to produce a storage bag for rafts or boats that has a large capacity and has a closing system that can secure the contents of the bag by the process of closing the bag.

FIG. *7a* is a perspective view of the invention with the top closed.

FIG. *7b* is a perspective view of the invention with the top closed and secured.

Figure 8:
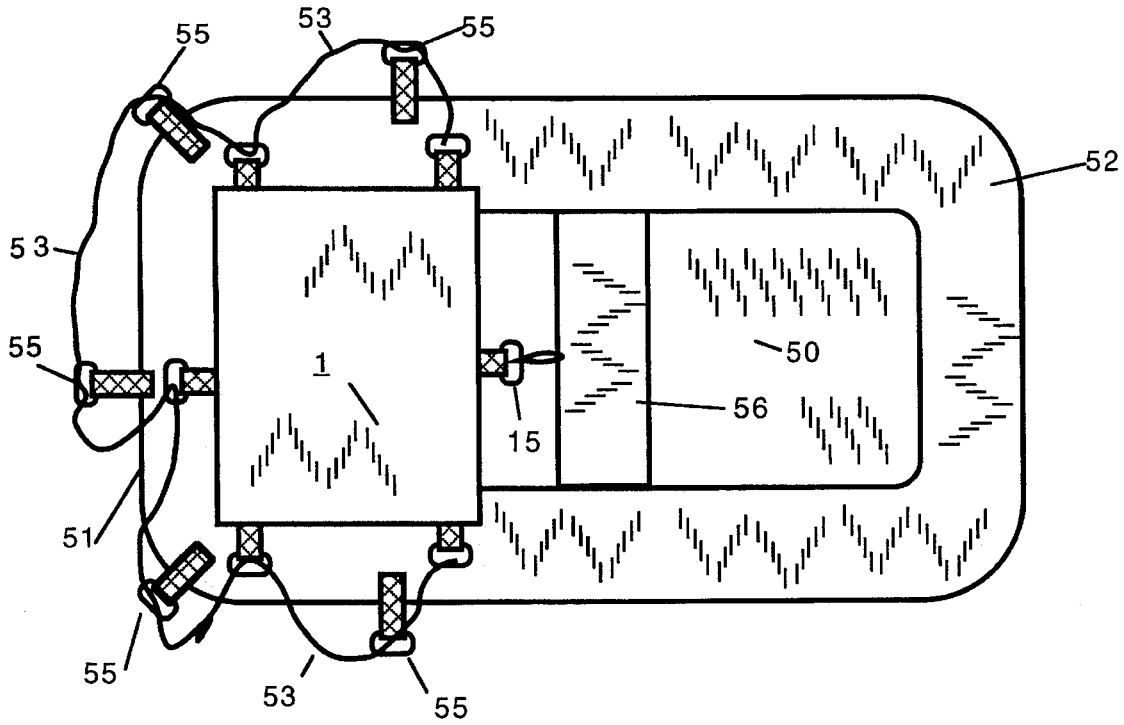

FIG. 8 is a top view of the first embodiment of the invention secured to a typical raft.

Figure 9:
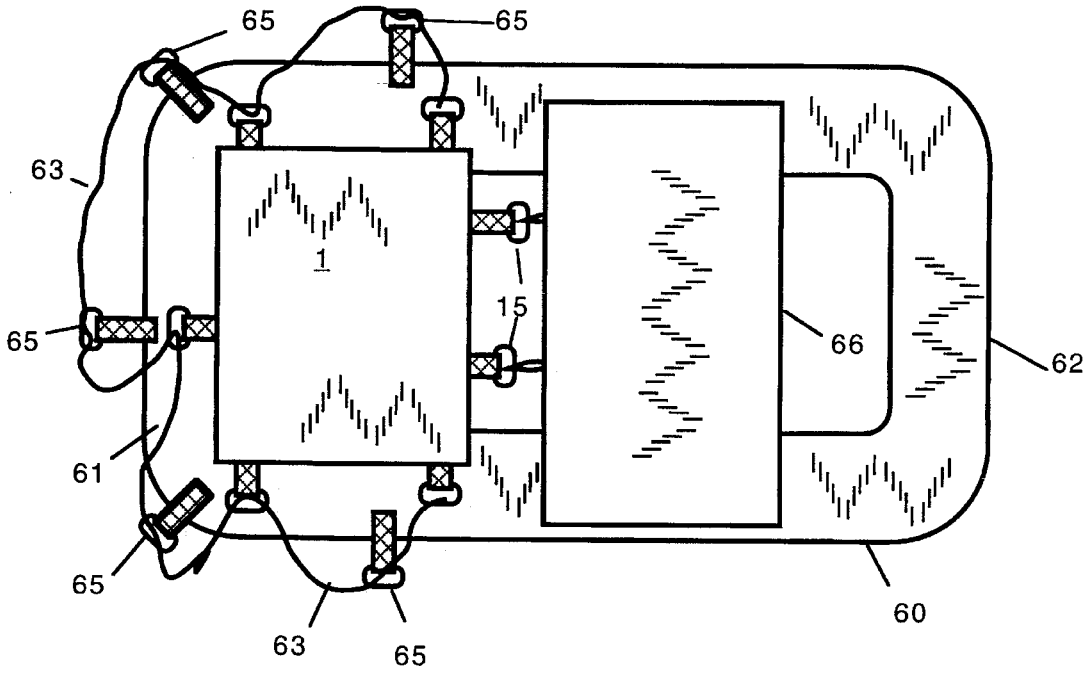

FIG. 9 is a top view of the second embodiment of the invention secured to a typical raft.

DETAILED DESCRIPTION OF THE INVENTION

Figure 1:
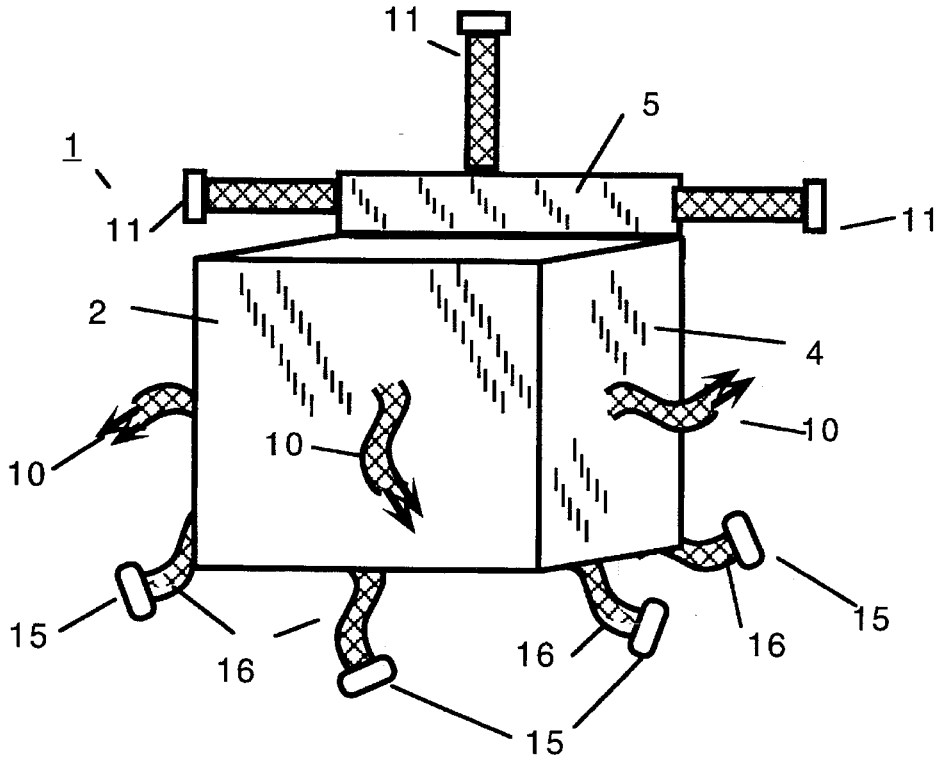
FIG. 1 is a perspective view of the invention for use in small craft.

Referring now to FIG. 1, the first embodiment of the invention 1 (for use in smaller craft) has a front panel 2, a back panel 3, two side panels 4, a top panel 5 and a bottom panel 6. The side panels 4 are stitched to the bottom panel 6 to form a bag type enclosure that has a hollow and open interior.

Figure 4:
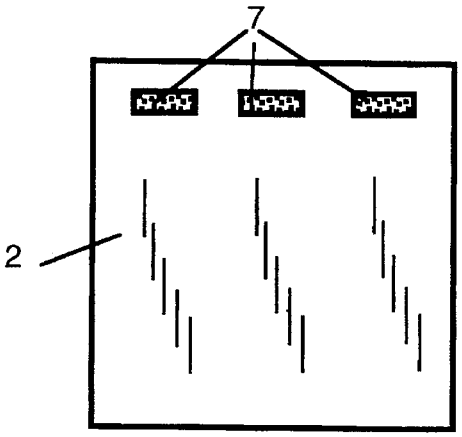
FIG. 4 is a detail view of the inside of the front panel.
Figure 5:
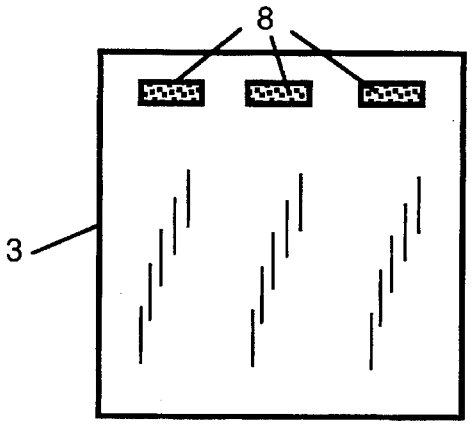
FIG. 5 is a detail view of the inside of the back panel.

Referring now to FIGS. 4 and 5, a strip 7, having a hook and loop type faster such as VELCRO attached to it, is sewn on the inside of the front panel 2, near the top of the front panel 2 as shown in FIG. 4. A corresponding strip 8 having the complementary fastener to strip 7 is sewn to the inside of the back panel 3, near the top of the panel 3 as shown in FIG. 5.

Figure 3:
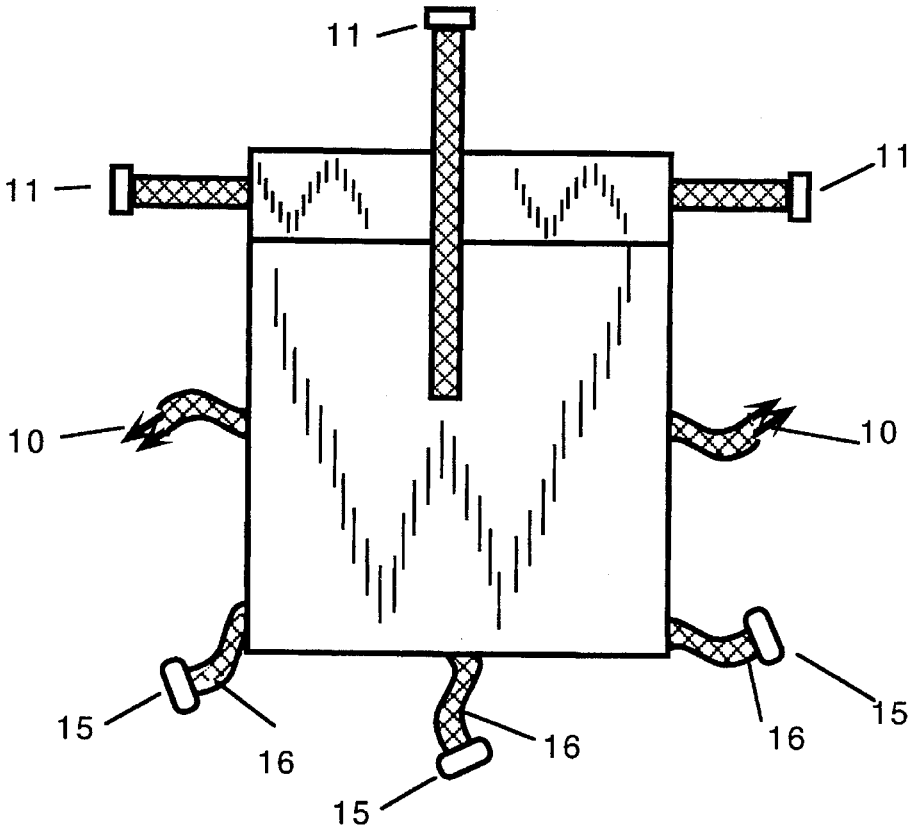
FIG. 3 is a back view of the invention for use in small craft.

A number of snap release clips 10 are attached to side panels 4 and to the back panel 3 (see FIG. 3). These clips 10 are connected to corresponding connectors 11 attached to the top panel 5. A snap release clip 10 is also attached to front panel 2. It is attached to a corresponding connector attached to the back panel 3. One type of suitable connector for the snap release clips 10 and connectors 11 are the FASTEX connectors. Of course, any similar type of fastening system may be used. These connectors are used to close and secure the top panel 5 of the bag.

Figure 2:
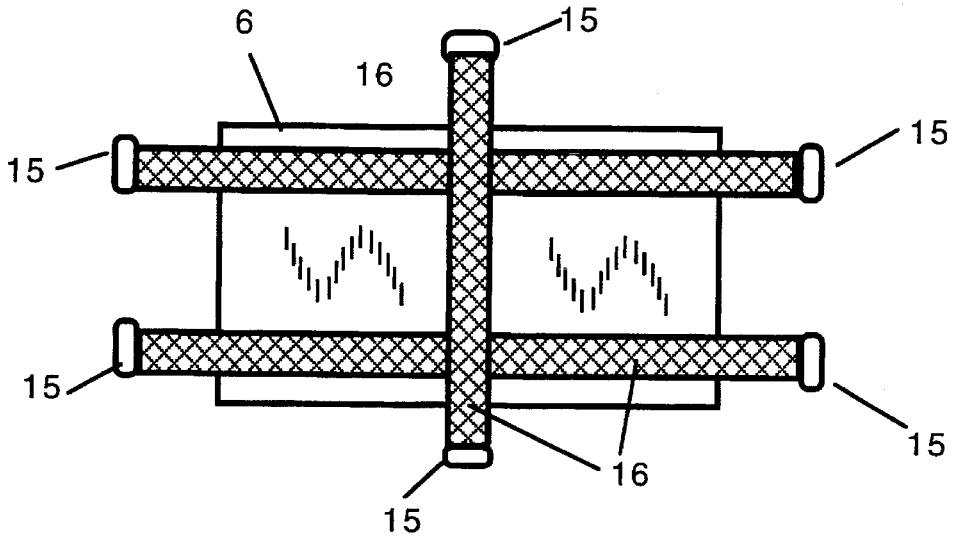
FIG. 2 is a detail view of the securing strap layout.
Figure 6:
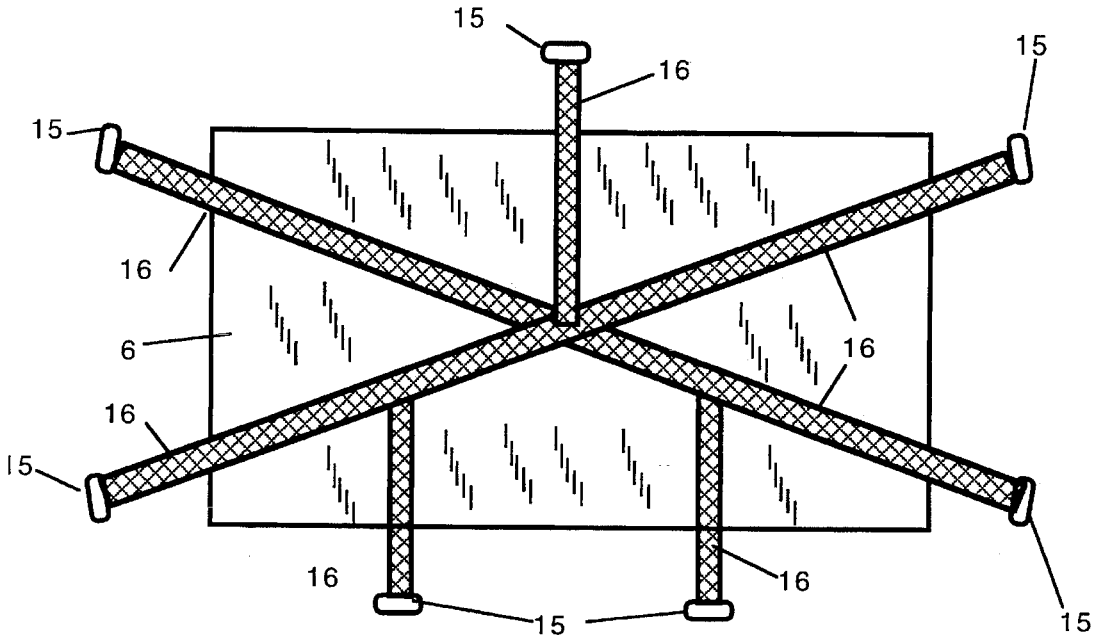
FIG. 6 is a bottom view of the invention for use in larger craft.

Referring now to FIGS. 2 and 6, a number of D-rings 15 are attached to the storage bag 1 as shown. FIG. 2 shows the bottom panel 6 of the bag 1. The D-rings 15 are attached to webbing straps 16. The bottom of the bag 6 is reinforced by stitching two inch polypropylene webbing straps 16 along the front and back seams. This webbing 16 is extended out from the bag 1 by four inches. One D-ring 15 is attached to each piece of webbing 16. A third length of webbing 16 is attached to the center of the bottom panel 6 as shown. Again four inch lengths of the webbing 16 extend past the end of the bag 1 to which D-rings 15 are attached. The D-rings 15 are typically sewn in the webbing straps 16 by folding over the end of the strap and sewing the webbing 16 with the D-ring 15 in place. The webbing straps are then sewn to the bottom panel 6 of the bag 1. The arrangement of the webbing straps 16 varies on the size of the bag 1, which depends on the side of the raft or other boat used. For example, FIG. 2 shows the D-ring pattern for a raft of less than 15 feet. FIG. 6 shows the configuration of the webbing and D-rings 15 for rafts larger than 15 feet.

FIG. 6 shows the configuration of the webbing straps 16 for use in larger craft (those longer than 15 feet-six inche. As in the first embodiment, the webbing straps 16 are attached to the bottom panel 6 of the bag 1. D-rings 15 are attached to the webbing straps 16 as before. In this embodiment, however, the webbing straps 16 are configured as shown in FIG. 6. Two straps 16 run diagonally and cross along the bottom panel 6 of the bag 1 in the center of the bottom panel 6 as shown. A third webbing strap 16 extends from the center of the bag 1 at the front panel 2. Two webbing straps 16 extend out from the back panel of the bag 3 as shown in FIG. 3. This arrangement works to better secure this size bag. Of course, the layout of the webbing straps 16 is not limited to those shown. However, these arrangements are preferred for the size of bags that are used in rafting.

FIG. 8 shows how the bag of FIG. 2 is secured to a raft; FIG. 9 shows how the bag of FIG. 4 attaches to a raft.

FIG. 8 shows how the first embodiment of the bag 1 (shown in FIG. 2 )is attached to a typical raft 50. The raft 50 has a bow 51 and a stern 52. The bag 1 can be placed either in the bow 51 or the stern 52. Boat straps 53 are looped through the D-rings 55 permanently attached to the raft as shown. 0f course, any other suitable tie points can be used either on a raft or any other suitable water craft. The boat straps 53 are also looped through the D-rings 15 on the bag 1 as shown. One bag D-ring 15 can be secured to either the raft frame 56 or the raft thwart 56 as shown. The boat straps 53 are cinched tightly, thus creating firm support for the bag 1.

FIG. 9 shows how the second embodiment of the bag 1 (shown in FIG. 6 ) is attached to a typical raft 60. The raft 60 has a bow 61 and a stern 62. The bag 1 can be placed either in the bow 61 or the stern 62. Boat straps 63 are looped through the D-rings 65 permanently attached to the raft 60 as shown. Of course, any other suitable tie points can be used either on a raft or any other suitable water craft. The boat straps 63 are also looped through the D-rings 15 on the bag 1 as shown. The two rear bag D-rings 15 can be secured to the raft frame 66 as shown. The boat straps 63 are cinched tightly, thus creating firm support for the bag 1.

Again, this method of tying the bags into a raft is not limited to rafts. Using the D-rings 15 and webbing straps 16, and using boat straps or bungee cords, the bag 1 can be secured to any other type of water craft that can accommodate the bag 1 by attaching the bag 1 to suitable tie down points 55 or 65 (as shown in FIGS. 8 and 9) found on most water craft.

Figure 7A:
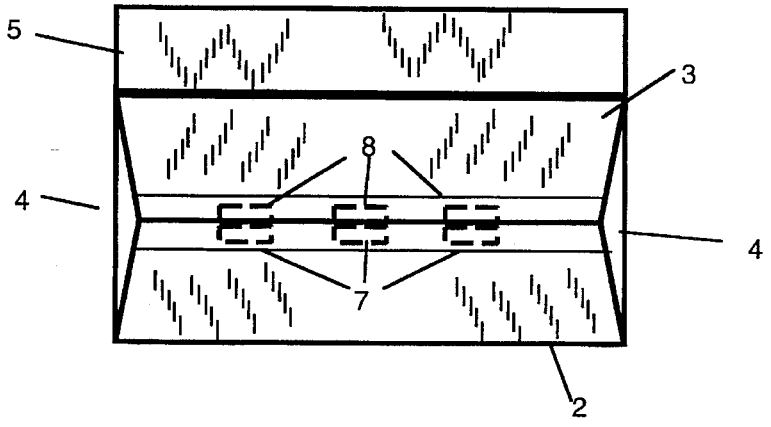
Figure 7B:
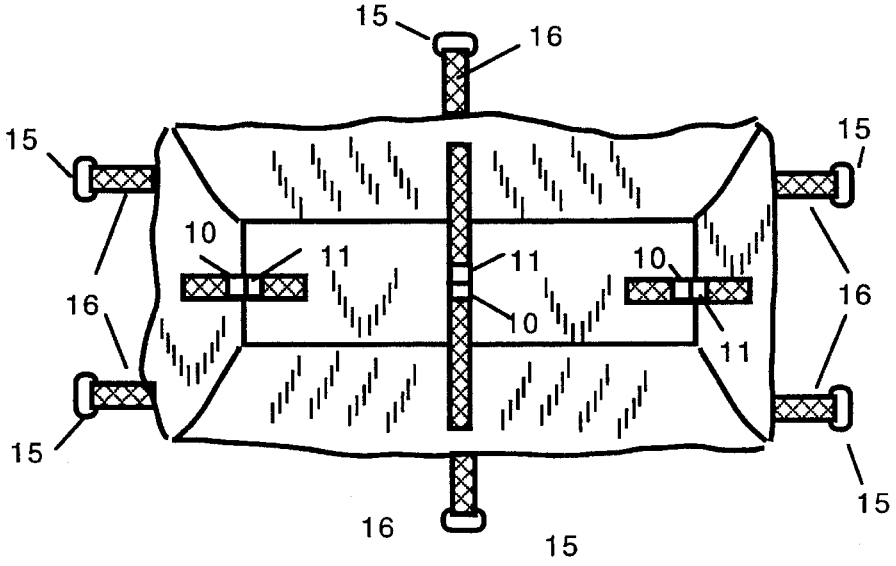

Once the bag 1 is attached to the raft, it can be filled with equipment of all types (not shown). Because the bag 1 does not have compartments, gear can be placed in the bag 1 freely. It is not necessary to secure the gear inside the bag 1 because the closing process ensures that the gear is held tightly and securely. Once the gear has been placed in the bag 1, the VELCRO strips 7 and 8 are pressed together, closing the bag 1 and forming a top seam 70, see FIG. 7*a* The top panel 5 is then folded over the top seam 70. The top panel 5 is then rolled up as necessary to bring the top panel 5 of the bag 1 down to the level of the supplies. Once the top panel 5 is rolled down, the snap release clips 10 are attached to the connectors 11 as shown in FIG. 7*b*. The connector straps are then pulled tight to cinch the top panel 5 of the bag 1 down until it is compressed against the gear inside the bag 1. In this way, the bag 1 is sealed and the gear is held securely within the bag 1. To access the bag 1, the process is reversed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A storage bag for raftS, and boats comprising:

a) a front panel, being generally rectangular and having a top edge and a bottom edge;

b) a back panel, being generally rectangular and having a top edge and a bottom edge;

c) a pair of oppositely disposed side panels, also being generally rectangular, each side panel having a top edge and a bottom edge, and being fixedly attached to said front panel and said back panel, thereby forming a box-like structure;

d) a bottom panel, being fixedly attached to the bottom edges of said front, back and side panels;

e) a top panel, being generally rectangular, and having a back edge, said top panel being hingibly attached to the top edge of said back panel;

f) means for sealably closing the top edges of said front and back panels;

g) a pair of webbing strips, fixedly attached to said bottom panel and running parallel to said front and back panels, each webbing strip having two ends whereby each end of said pair of webbing strips extending outwardly from said bottom panel at least four inches, each webbing strip further including a D-ring, fixedly attached to each of the ends of said webbing strips; and h) a third webbing strip, fixedly attached to said bottom panel and running perpendicular to said front and back panels, said third webbing strip having two ends extending outwardly from said bottom panel, at least four inches, said third webbing strip further including a D-ring, fixedly attached to each of the ends of said third webbing strip.

2. The storage bag for rafts, and boats of claim 1 wherein said storage bag has an open interior.

3. The storage bag for rafts, and boats of claim 1 wherein the means for sealably closing the top edges of said front and back panels includes hook and loop fastener strips being fixedly attached to the top edges of said front and back panels.

4. The storage bag for rafts, and boats of claim 1 wherein the means for sealably closing the top edges of said front and rear panels further includes:

a) a pair of snap release clips, fixedly attached to said pair of oppositely disposed side panels;

b) a third snap release clip, fixedly attached to said front panel; and c)corresponding snap release connectors, being fixedly attached to said top panel, such that when said top panel is placed on said storage bag, said snap release clips are aligned with the corresponding said snap release connectors.

5. A storage bag for rafts, and boats comprising:

a) a front panel, being generally rectangular and having a top edge and a bottom edge;

b) a back panel, being generally rectangular and having a top edge and a bottom edge;

c) a pair of oppositely disposed side panels, also being generally rectangular, each side panel having a top edge and a bottom edge, and being fixedly attached to said front panel and said back panel, thereby forming a box-like structure;

d) a bottom panel, having a center point, being fixedly attached to the bottom edges of said front, back and side panels;

e) a top panel, being generally rectangular, and having a back edge, said top panel being hingibly attached to the top edge of said back panel;

f) means for sealably closing the top edges of said front and rear panels;

g) a first pair of webbing strips, fixedly attached to said bottom panel and running diagonally with respect to said front and back panels, said pair of webbing strips crossing at the center point of said bottom panel, each webbing strip having two ends whereby each end of the webbing strips extends outwardly from said bottom panel at least four inches, each webbing strip further including a D-ring, fixedly attached to each end of the webbing strips; and h) a third webbing strip, fixedly attached to said bottom panel and running perpendicular to said front panel, and being aligned with an imaginary line extending through the center point of said bottom panel and running perpendicular to said front panel, said third webbing strip having an end extending outwardly from said bottom panel at said front panel at least four inches, said third webbing strip further including a D-ring, fixedly attached to the end of said third webbing strip;

i) a second pair of webbing strips, fixedly attached to said bottom panel and running perpendicular to said back panel, and being aligned equidistant from an imaginary line extending through the center point of said bottom panel and running perpendicular to said back panel, said second pair of webbing strips having ends extending outwardly from said bottom panel at said back panel, at least four inches, said second pair of webbing strips further including a D-ring, fixedly attached to each end of said second pair of webbing strips.

6. The storage bag for rafts, and boats of claim 5 wherein said storage bag has an open interior.

7. The storage bag for rafts, and boats and the like of claim 5 wherein the means for sealably closing the top edges of said front and rear panels includes hook and loop fastener strips being fixedly attached to the top edge of said front and back panels.

8. The storage bag for rafts, and boats of claim 5 wherein the means for sealably closing the top edges of said front and rear panels further includes:

a) a pair of snap release clips, fixedly attached to said pair of oppositely disposed side panels;

b) a third snap release clip, fixedly attached to said front panel; and c) corresponding snap release connectors, being fixedly attached to said top panel, such that when said top panel is placed on said storage bag, said snap release clips are aligned with the corresponding said snap release connectors.

9. A method of use for a storage bag, for water craft having a plurality of tie points fixedly attached thereto, said storage bag having a front panel, having a top edge and a bottom edge; a back panel, having a top edge and a bottom edge; a pair of oppositely disposed side panels, each side panel having a top edge and a bottom edge, and being fixedly attached to said front panel and said back panel, thereby forming a box-like structure; a bottom panel, being fixedly attached to the bottom edges of said front, back and side panels; a top flap, being generally rectangular, and having a back edge, said top flap being hingably attached to the top edge of said back panel; a plurality of webbing strips, fixedly attached to said bottom panel and extending outwardly from said bottom panel at least four inches, each webbing strip further including a D-ring, fixedly attached to each of the ends of said webbing strips; a plurality of hook and loop fastener strips being fixedly attached to the top edge of said front and back panels; a plurality of snap release clips, fixedly attached to said storage bag; and a corresponding number of snap release connectors, being fixedly attached to said top panel; comprising the steps of:

a) placing the storage bag inside said water craft;

b) aligning said D-rings on said webbing strips with said plurality of tie points on said water craft; and c) securing said D-rings to said plurality of tie points by
i) securing a length of boat strap to a tie point;
ii) weaving said length of boat strap through a D-ring;
iii) weaving said length of boat strap through another tie point;
iv) weaving said length of boat strap through another tie point;
v) repeating steps ii and iii until all D-rings are connected to the length of boat strap; and vi) securing the length of boat strap to another tie point.

10. The method of claim 9 further comprising-the steps of:

a) filling said storage bag; and b) sealing said storage bag closed.

11. The method of claim 10 wherein the step of sealing the storage bag closed includes the step of:

a) engaging said strips of hook and loop fastener on said front and back panels;

b) folding said top panel over said storage bag; and c) connecting said plurality of snap release clips with said snap release connectors.

* * * * *